US005552069A

United States Patent [19]

Avery et al.

[11] Patent Number: 5,552,069

[45] Date of Patent: Sep. 3, 1996

[54] ADDITIVES FOR FUELS AND LUBRICANTS

[75] Inventors: Noyes L. Avery, Bryn Mawr; Joan C. Axelrod, Media, both of Pa.; James T. Carey, Medford, N.J.; John Hiebert, Levittown, Pa.; Andrew G. Horodysky, Cherry Hill, N.J.

[73] Assignee: Mobil Oil Corporation, Fairfax, Va.

[21] Appl. No.: 450,826

[22] Filed: May 25, 1995

Related U.S. Application Data

[62] Division of Ser. No. 217,818, Mar. 25, 1994.

[51] Int. Cl.[6] ..... C10M 135/36

[52] U.S. Cl. ..... 508/229

[58] Field of Search ..... 252/47, 47.5, 50

[56] References Cited

U.S. PATENT DOCUMENTS 4,784,782 11/1988 Pialet et al. ..... 252/47.5

5,030,370 7/1991 Patil et al. ..... 252/50

5,232,615 8/1993 Patil et al. ..... 252/50

5,271,856 12/1993 Patil et al. ..... 252/50

*Primary Examiner*—Jacqueline V. Howard

*Attorney, Agent, or Firm*—Ronald A. Bleeker; Malcolm D. Keen; Penny L. Prater

[57] ABSTRACT

Polyalkylene amine coupled heterocyclic compounds are effective multifunctional additives, providing cleanliness to fuels and lubricants as well as anti-wear, friction-modifying, thermal and oxidative stabilizing properties. The beneficial effects of the product of the instant invention apparently result from an internal synergism between the polyalkylene amine groups and the heterocyclic groups.

8 Claims, No Drawings

ADDITIVES FOR FUELS AND LUBRICANTS

This is a division of copending application Ser. No. 08/217,818, filed on Mar. 25, 1994 pending.

FIELD OF THE INVENTION

This invention is directed to polyalklene amines which have been coupled to heterocyclic compounds by means of carbonyl groups and the use of the resulting products as additives in fuels and lubricants. More particularly, it is directed to fuel and lubricant compositions containing such additives.

BACKGROUND OF THE INVENTION

Additives impart special qualities to fuels and lubricants, providing new properties or enhancing those already present. The use of polyalkylene amines in fuel compositions as detergents is well known. They are effective in maintaining the cleanliness of the mixture formation and intake systems of gasoline engines (i.e., carburetor, injection nozzles, intake valves and mixture distributor), since they enable fuels to decompose cleanly at high temperatures leaving little or no residue. Fuel additives also reduce emissions from internal combustion engines. Polyalkylene amines have also been used as dispersants and detergents in lubricants, in which they impart cleanliness and stability at high temperatures. Polyalkylene amines have generally been used as dispersant and detergent additives. Other additives have been necessary to impart antiwear and corrosion-inhibiting properties to the fuel or lubricant, such as low molecular weight sulfur-containing heterocyclic additives.

The beneficial effects of the product of the instant invention are believed to be the result of an internal synergism between the polyalkylene amine groups, and the heterocyclic groups containing sulfur and nitrogen. The additives of this invention show good thermal decomposition, oxidative stability, and compatibility with other commonly used fuel or lubricant additives when admixed with them. They are effective performance enhancers in either fuel or lubricant compositions.

DESCRIPTION OF THE PRIOR ART

The use of polyalkyleneamines as additives in lubricant compositions is well known in the prior art. U.S. Pat. No. 5,152,909 (DeRosa et al) discloses the use of polyisobutyleneamines in the preparation of antioxidant and corrosion resistance additives for railway crankcase lubricants. Although the polyisobutyleneamines of DeRosa et al are linked with a heterocyclic to form the additive, they differ from the instant invention in the chemistry of their synthesis. DeRosa et al reacts maleic anhydride with oligomeric polyisobutylene to form oligomeric anhydride. The anhydride then reacts with N-alkyl-diamine. The intermediate then reacts with polyaromatic disocyanate, then with 1,3,4 thiadiazole.

U.S. Pat. Nos. 5,004,478 (Vogel et al); 5,112,364 (Rath et al) and DE3942860 disclose the use of polyisobutylenes amines alone as gasoline and fuel additives. These compositions provide thermal decomposition and cleanliness features. The polyisobutyleneamine additives of these inventions are not coupled with other compounds as in the instant invention.

Low molecular weight sulfur-containing heterocyclic additives such as those disclosed in U.S. Pat. No. 4,382,869 (Horodysky et al) and U.S. Pat. No. 4,301,019 (Horodysky et al) provide friction reducing and antiwear properties for lubricant applications. These compositions, however, do not provide the thermal decomposition and cleanliness features, coupled with the excellent detergency properties of the new fuel additives disclosed in the instant invention. These properties are critical for severe service fuel and lubricant applications.

SUMMARY OF THE INVENTION

The instant invention is directed to novel adducts of polymeric amines. More particularly, it is directed to products of heterocyclic groups containing sulfur and nitrogen which are reacted with a polyalkylene amine and a carbonyl linker. It has now been discovered that additives containing polyalkylene amines coupled to sulfur and nitrogen heterocyclics by carbonyl linking groups can provide excellent friction-reducing and antiwear properties combined with superior high temperature thermal decomposition and cleanliness features when used in light distillate hydrocarbon and/or oxygenated fuels or in lubricants. Additional corrosion inhibiting, fuel economy improving, emissions reducing, metal deactivating, and/or antioxidant properties are also potentially present.

The compositions of the instant invention are readily made in a one-step procedure that could, in one embodiment, be implemented during manufacture of the additive composition. These additives could provide desirable performance features at a modest cost. Furthermore, they do not contain any environmentally or toxicologically undesirable materials such as heavy metals or corrosive raw materials. Use in either fuels or lubricants could also reduce harmful emissions generated by internal combustion engines.

DESCRIPTION OF THE PREFERRED EMBODIMENTS

This invention is directed to additives suitable for use in fuels or lubricant oils prepared in a suitable reaction zone using a polyalkylene amine having an average molecular weight of about 500 to 2000. A heterocyclic compound comprising sulfur and nitrogen, and a carbonyl linker such as an aldehyde. The preferred polyalkyleneamines are those having a long chain hydrocarbon group of at least about 30 carbon atoms, preferably 30 to 120 carbon atoms. Amines of this type include polyisobutyleneamine. Such amines might also include alternate polymeric amines such as those below:

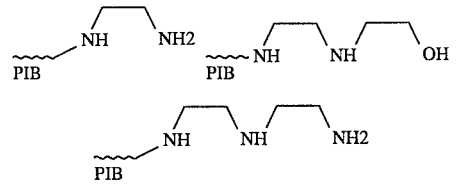

Polyisobutyleneamines useful in this invention generally have an average molecular weight of about 500–2000 amu, and can be prepared by chlorination or hydroformlation of a reactive polyolefin such as polyisobutylene, and subsequent amination with ammonia, hydrocarbyl amine, hydrocarbyl diamine, hydrocarbyl polyamine, alkoxylated hydrocarbyl amines, or mixtures thereof. Ammonia, ethylenediamine, propylenetriamine, diethylenetriamine, triethylenetetramine, tetraethylenepentamine, piperazines, hexamethylenediamine, hydroxyalkylethylenediamines, hydroxyalkyl triethyleneteramines, and similar compounds can be converted to polyalkyleneamines by these procedures. Mixtures of the above and similar amines can also be used effectively. Alternatively, these amines can be prepared by chlorination or halogenation of appropriate polymeric olefins, and then converted into corresponding polyalkyleneamine derivatives using these or other known methods of manufacture. Polyisobutylene (PIB) is an oligomeric isobutylene segment that has a corresponding molecular weight range between 500 and 200, preferably 1000. A high concentration of terminal amine groups made from high purity isobutylene is most desirable. Although a polyolefin having a terminal vinylic content (i.e., more than 50% of the molecules present have a terminal vinyl group) of more than 50% can be used, a polyolefin with a terminal vinylic content of greater than 70% is preferred. A terminal vinylic content of over 85% is most preferred. The polyalkylene amines can also optionally contain sulfur, oxygen or additional nitrogen and may have other functional groups. The generalized reaction is as follows; R - - - NH2+Carbonyl Linker+Heterocyclic=Detergent with antiwear and anticorrosion properties (R=polyalkylene)

Carbonyl groups effective in the instant invention include aldehydes such as formaldehyde, acetaldehyde, propionaldehyde, butyraldehyde, 2-ethylhexanal, and related carbonyl-containing reactants. Carbonyl linkers can also include aromatic aldehydes as well as glyoxals and other dicarbonyl compounds. Although ketones and carboxylic acids maybe used in the instant invention, aldehydes are the preferred carbonyl compounds.

The temperature range for the reaction is from 50° to 250° C. The preferred range is from 70° to 150° C. Atmospheric pressure is suitable throughout the reaction although pressure may range from subatmospheric to about 500 psig. Pressures below atmospheric may be useful for solvent removal, but are not necessary if a low boiling point solvent is used.

A solvent for the reaction is desirable. In general, any polar or non-polar, unreactive solvent can be used, including toluene, xylene, 1,4-dioxane or reaction solvents such as butanol, pentanols, etc. Time for completing the reaction will range from 1 to 20 hours.

Heterocyclics particularly useful in the instant invention include thiadiazoles. Some of the thiadiazoles useful in the practice invention are more particularly called mercaptothiadiazoles, and can include 2,5-dimercaptothiadiazole and have the formula:

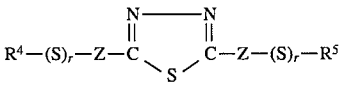

wherein $R^4$ and $R^5$ are hydrogen or hydrocarbyl groups, containing from 1 to 30 carbon atoms, r is from 0 to 3 and Z is nitrogen or sulfur, one of which must be sulfur. The hydrocarbyl groups can be alkyl, aryl, alkenyl alkaryl or aralkyl, preferably alkyl, and specifically include methyl, butyl, octyl, decyl, dodecyl, octadecyl, phenyl, tolyl, benzyl, and the like. One of $R^4$ and $R^5$ must be hydrogen. In general, any heterocyclic molecule with a reactive S—H group may be used. They can be made in accordance with the method described in U.S. Pat. No. 2,719,125, which is incorporated herein by reference. They may also be purchased from commercial sources.

Some sulfur-containing heterocyclics useful in the instant invention include 2-mercapto-1, 3,4-thiadiazole, amino-substituted mercaptothiadiazoles, 2-mercaptothiadiazoles, and 2-mercaptobenzimidazoles. Other mercaptothiadiazoles useful herein also include amino derivatives such as amino mercapto-thiadiazole:

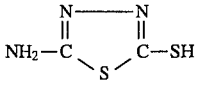

An excess of one reagent or another can be used in the instant invention. Molar quantities, more than molar quantities, or less than molar quantities of either polyalkylene amine, carbonyl linking group, or heterocyclic species can be used. With the use of a difunctional heterocyclic reactant and monofunctional carbonyl linker, a molar ratio of 1:2:1 of amine:carbonyl linker:heterocyclic reactant can be used to advantage. In general, however, a 100% excess or up to 50% deficiency of any reactant can be used.

The fuels combined with the additive of this invention are liquid hydrocarbon combustion fuels, including the distillate fuels, i.e., gasoline and fuel oils. Accordingly, the fuels that may be improved in accordance with the present invention are hydrocarbon fractions having an initial boiling point of at least about 100° F. and an end-boiling point no higher than about 750° F. and boiling continuously throughout their distillation range. These fuels oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate, fuel oils, or mixtures of straight run distillate fuel oils, naphthas, and the like with cracked distillate stocks. Moreover, such fuel oils can be treated in accordance with well known commercial methods, including acid or caustic treatment, hydrogenation, solvent refining, clay treatment, and the like. The distillate fuel oils are characterized by their relatively low viscosities, pour points, and similar properties. The principal property which characterizes the contemplated hydrocarbons, however, is the distillation range. As mentioned hereinbefore, this range lies between about 100° F. and about 750° F. Obviously, the distillation range of each individual fuel oil will cover a narrower boiling range, but falling, nevertheless, within the above specified limits. Likewise, each fuel oil will boil continuously throughout its distillation range. Contemplated among the fuel oils are numbers 1, 2 and 3 fuel oils (useful in heating and in diesel engines) and the jet combustion fuels. The domestic fuel oils generally conform to the specifications set forth in ASTM Specifications D396- 48T. Specifications for diesel fuels are defined in ASTM Specification D975-48T. Typically jet fuels are defined in Military Specifications. Additives such as detergents, demulsufiers and cleanliness agents can be used in fuels.

The gasolines that are improved by the additive compositions of this invention are mixtures of hydrocarbons having an initial boiling point falling between about 75° F. and about 135° F. and an end-boiling point falling between about 250° F. and about 450° F. As is well known, in the art, motor gasoline can be straight run stock, catalytic or thermal reformate, cracked stock, alkylated natural gasoline and aromatic hydrocarbons. All of these are contemplated.

If the additive compositions of this invention are to be incorporated into a lubricating oil they are added in a concentration of between 0.1 and 2%. If the composition is to be incorporated into a fuel such as distillate or gasoline the concentration is between 1 and 500 pounds per thousand barrels. Preferably the concentration is between 10 and 200 pounds per thousand barrels. Additional additives may be used in lubricants, such as detergents, pour point depressants, viscosity index improvers, antiwear components and corrosion inhibitors. Particular compounds useful as additives include polymeric succinimides, metallic or ashless phosphates or sulfonates, metallic or non-metallic dithiophosphates or hydrocarbon oxygenated polymers.

Of particular significance in the instant invention, in the case of lubricants, is the ability to impart cleanliness and stability features at high temperatures. The additives of this invention also improve the resistance to oxidation and corrosion of oleaginous materials. Such materials include lubricating media which may comprise liquid oils, in the form of either a mineral oil or a synthetic oil, or mixtures thereof, or in the form of a grease in which any of the aforementioned oils are employed as a vehicle. In general, mineral oils, both paraffinic, naphthenic and mixtures thereof, employed as the lubricant, or grease vehicle, may be of any suitable lubricating viscosity range, as for example, from about 45 SUS at 100° F. to about 600 SUS at 100° F., and preferably, from about 40 SUS to about 250 SUS at 210° F. These oils may have viscosity indices ranging to about 100 or higher. Viscosity indices from about 70 to about 95 are preferred. The average molecular weights of these oils may range from about 250 to 800.

Having described the invention broadly, the following are offered as specific illustrations. They are only illustrative and are not intended to limit the invention.

EXAMPLE 1

Reaction Product of Polyisobutyleneamine, Paraformaldehyde and Dimercaptothiadiazole About 221 g of an approximately 50% solution of polyisobutyleneamine in an inert hydrocarbon solvent having a molecular weight of approximately 1,000 was combined with 4 g of paraformaldehyde and 100 ml toluene solvent in a reactor equipped with agitator, heater, inerted $N_2$ atmosphere, and Dean-Stark tube with condenser. The Dean-Stark tube is used to continuously remove water from the reaction mixture. After a period of agitation at temperatures up to 50° C., 18 g of 2,5-dimercapto-1,3,4-thiadiazole was slowly added with agitation. The reactants were heated to approximately 95° C., and vacuum was applied to begin azeotropic distillation of water and toluene solvent. After water removal ceased, the product was filtered to remove unreacted solids. The remaining solvent was then removed by distillation under reduced pressure to form a greenish-brown viscous liquid. The product contained 6.0% sulfur and 3.3% nitrogen.

EXAMPLE 2

Reaction Product of Polyisobutyleneamine, Paraformaldehyde and Dimercaptothiadiazole Approximately 221 g of the polyisobutyleneamine solution described in Example 1 was reacted with 4 g paraformaldehyde and 9 g of 2,5-dimercapto-1,3,4-thiadiazole using the generalized reaction scheme of Example 1. Approximately 141 g of relatively solvent-free product was recovered as a greenish-brown viscous liquid. The liquid contained 3.9% sulfur and 2.4% nitrogen.

EXAMPLE 3

Reaction Product of Polyisobutyleneamine, Paraformaldehyde and 2-Mercaptobenzothiazole Approximately 221 g of the polyisobutyleneamine solution of Example 1, 4 g of paraformaldehyde, 20 g of 2-mercaptobenzothiazole, and 100 ml toluene additional solvent were reacted using the generalized reaction method of Example 1. Approximately 138 g of a clear orange viscous liquid was isolated after filtration and solvent distillation. The product contained 3.1% sulfur and 1.9% nitrogen.

EXAMPLE 4

Reaction Product of Polyisobutyleneamine, Paraformaldehyde and 2-Mercaptothiazole Approximately 221 g of the polyisobutyleneamine solution of Example 1, 4 g of paraformaldehyde, 20 g of 2-mercaptobenzothiazole in 100 ml toluene additional solvent were reacted using the generalized reaction method of Example 3, except that the polyisobutyleneamine and paraformaldehyde were pre-reacted together at up to 134° C. (273.2° F.) before addition of the 2-mercaptobenzothiazole. Approximately 142 g of a viscous orange liquid was isolated after filtration. A greater amount of unreacted solids was also collected on the filter when compared to Example 3. The lower sulfur analysis of 2.4% and lower nitrogen analysis of 1.7% confirmed that the yield of Example 3 was somewhat greater than that of Example 4.

EXAMPLE 5

Reaction Product of Polyisobutyleneamine, Paraformaldehyde and 2-Mercaptothiazole Approximately 221 g of the polyisobutyleneamine solution of Example 1, 4 g of paraformaldehyde, 10 g of 2-mercaptobenzothiazole in 100 ml toluene additional solvent were reacted using the generalized reaction method of Example 3. Approximately 152 ml of a clear orange liquid product was isolated. The sulfur content was 2.4%, and the nitrogen analysis was 1.7%.

EXAMPLE 6

Reaction Product of Polyisobutyleneamine, Paraformaldehyde and 2-Mercaptobenzimidazole Approximately 221 g of the polyisobutyleneamine solution of Example 1, 4 g of paraformaldehyde, 18 g of 2-mercaptobenzothiazole in 100 ml toluene additional solvent were reacted using the generalized reaction procedure of Example 1. The product weighted 143 g and contained 1.4% sulfur and 2.5% nitrogen.

EXAMPLE 7

Reaction Product of Polyisobutyleneamine, Paraformaldehyde and 2-Mercaptobenzimidazole Approximately 221 g of the polyisobutyleneamine solution of Example 1, 4 g of paraformaldehyde, 9 g of 2-mercaptobenzothiazole in 100 ml toluene additional solvent were reacted using the generalized reaction procedure of Example 1. The product was a clear pale yellow viscous liquid weighing 191 g. The product contained 1.1% sulfur and 1.9% nitrogen.

Thermal Decomposition Properties

The products of the Examples were evaluated with respect to cleanliness during thermal decomposition using thermogravimetric analysis as shown in Table 1 below. Thermogravimetric analysis was performed by heating the sample at 20° C./min in air flowing at 100 ml/min using a thermogravimetric analyzer. The percent residue remaining at 425° C. was recorded; little or no residue is most desirable. As the data illustrates, Example 7 left the least amount of residue.

TABLE 1

High Temperature Performance/Cleanliness Thermogravimetric Analysis

| Example | % Residue @ 425° C. (797° F.) | Temp. for 0% Residue, °C. | °F. |
|---|---|---|---|
| 1 | 2.8 | 540 | 1004 |
| 2 | 2.2 | 540 | 1004 |
| 3 | 1.3 | 540 | 1004 |
| 5 | 1.5 | 560 | 1040 |
| 6 | 1.0 | 540 | 1004 |
| 7 | 0.4 | 496 | 925 |

As can be seen from the thermogravimetric analyses results, the products of this invention show exceptional cleanliness and high temperature decomposition features. Example 4 was not included in this analysis.

Catalytic Oxidation Test

The products of these Examples were then evaluated with respect to oxidative stability and corrosion reducing properties. The Catalytic Oxidation Test was used at 325° F. for forty hours. In the Catalytic Oxidation Test, the reference lubricant was subjected to a stream of air which was bubbled through at a rate of 5 liters per hour and 325° F. for forty hours. Present were samples of metals commonly used in engine construction such as iron, copper, aluminum and lead. U.S. Pat. No. 3,682,980, herein incorporated by reference in its entirety, may be consulted for more complete details of the test. Minimizing of viscosity increase or neutralization number shows control of oxidation. The data are reported as increase in viscosity (%), increase in Total Acid Number (TAN), and amount of lead loss, in mg., as shown in Table 2.

TABLE 2

Oxidative Stability/Corrosion Inhibition

| Example | Viscosity Increase % | Acid No. Increase | Lead Loss, mg |
|---|---|---|---|
| 200 SUS solvent paraffinic neutral lubricating oil (Reference Oil) with no additives | 430% | 12.6 | 491 |
| Reference oil plus 2 wt % of product of Example 2 | 43% | 5.2 | 8.3 |

The results clearly show that the products of this invention do not adversely affect the oxidative stability or corrosivity of petroleum products formulated therefrom. Viscosity increase, Acid No. increase, and Load Loss are distinctly minimized by the addition of 2 wt % of Example 2.

Copper Corrosivity

Example 1 was evaluated with respect to copper corrosivity properties. Two percent of Example 1 was blended into a 200 SUS solvent paraffinic neutral lubricating oil and evaluated using the Copper Strip Corrosivity Test, ASTM D-130 at 250° F. (121.11° C.) for three hours. The result were rated as 1A, indicating no corrosive tendencies. In fact, 1A is the best possible rating using this test for copper corrosivity.

The products of the Examples were evaluated as shown in Table 3 using the 4-Ball Wear Test at 1800 rpm, 40 kg load, 30 minutes, at 93° C. (199.4° F.). Reported is the wear factor K which is proportional to the wear volume, and cF, the coefficient of friction. The products of the examples were blended into the reference oil at 2.0 wt. % and evaluated in the Shell Four-Ball Wear Test using a 40 kg load, at 1800 rpm for thirty minutes as shown in Table 3. They were tested for friction molding characteristics in the Low Velocity Friction Apparatus (LVFA) in fully formulated mineral or synthetic automotive engine oils containing antioxidant, dispersant and detergent additives. The LVFA is fully described in U.S. Pat. No. 5,511,482.

In the Shell Four Ball Wear Test, three stationary balls are placed in the reference lubricant. The compound to be tested is added thereto, and a fourth ball is placed in a chuck mounted on a device which can be used to spin the ball at known speeds and loads. The samples were tested using 0.5 inch stainless steel balls of 52100 steel for thirty minutes.

TABLE 3

4-Ball Wear Test
1800 rpm, 40 kg load, 30 Minutes, 93° C. (199.4° F.)

| Example | Wear K Factor | Coefficient of Friction, cF |
|---|---|---|
| 200 SUS solvent paraffinic neutral lubricating oil | 920 | |
| Reference oil plus 2 wt % Example 2 | 18 | 0.078 |

The results clearly show the wear reducing properties of this type of composition. Wear volumes have been reduced to almost 1/50th of the initial wear volume of the unadditized oil.

What is claimed is:

1. A lubricant composition comprising a lubricating oil or a grease prepared therefrom and an effective amount, sufficient to enhance cleanliness, provide stability at high temperatures, retard wear, and inhibit corrosion in an engine, of a reaction product obtained by reacting a (1) polyalkylene amine which is at least 30 carbons in length with (2) a carbonyl linking group and (3) a heterocyclic compound having both sulfur and nitrogen molecules at a temperature in the range from 50° C. to 250° C. and at a pressure from subatmospheric to about 500 psig using a ratio of polyalkylene to carbonyl linking group to heterocyclic compound in a range from 0.1:10:0.1 to 10:0.1:10.

2. The composition of claim 1, wherein the polyalkylene amine is polyisobutylene amine wherein the polyisobutylene amine is derived from polyisobutylene molecules of which at least 70% have a terminal vinyl group.

3. The composition of claim 2, wherein the polyisobutyleneamine is derived from polyisobutylene molecules of which at least 80% have a terminal vinyl group.

4. The composition of claim 1, wherein the amount of reaction product present is in the range from 0.1 to 5.0 wt %.

5. The composition of claim 1, wherein at least one compound selected from the group consisting of ammonia, ethylenediamine, diethylenetriamine, triethylenetetramine, tetraethylenepentamine, piperazines, hexamethylenediamine, hydroxyalkyl ethylenediamines, and hydroxyalkyl teraethylenetetramines is to be incorporated into the polyalkylene amine.

6. The composition of claim 1, wherein the carbonyl linking group is an aldehyde.

7. The composition of claim 1, wherein the lubricating oil is selected from the group consisting of mineral oils, synthetic oils or mixtures thereof.

8. A lubricant composition comprising a lubricating oil or a grease prepared therefrom and an effective amount, sufficient to enhance cleanliness, provide stability at high temperatures, retard wear, and inhibit corrosion in an engine, of a reaction product obtained by reacting a (1) polyisobutyleneamine which is derived from polyisobutylene molecules of which at least 70% have a terminal vinyl group (2) paraformaldehyde and (3) 2,5-dimercapto-1,3,4 thiadiazole.

* * * * *

UNITED STATES PATENT AND TRADEMARK OFFICE

CERTIFICATE OF CORRECTION

PATENT NO. : 5,552,069

DATED : September 3, 1996

INVENTOR(S) : Noyes L. Avery et al.

It is certified that error appears in the above-indentified patent and that said Letters Patent is hereby corrected as shown below:

Col. 8, line 58, Claim 3, delete "80%" and insert --85%--.

Signed and Sealed this

Twenty-fourth Day of December, 1996

*Attest:*

Bruce Lehman

BRUCE LEHMAN

*Attesting Officer*

*Commissioner of Patents and Trademarks*